US006402087B1

(12) United States Patent
Farina et al.

(10) Patent No.: US 6,402,087 B1
(45) Date of Patent: Jun. 11, 2002

(54) FIXED CANARDS MANEUVERABILITY ENHANCEMENT

(75) Inventors: Anthony Farina, Hackettstown; Michael J. Amoruso, Long Valley; Wilfredo Toledo, Hasbrouck Heights, all of NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/613,147

(22) Filed: Jul. 11, 2000

(51) Int. Cl.[7] ..... F42B 10/60; F42B 15/01; F41G 7/00

(52) U.S. Cl. ..... 244/3.21; 244/3.1; 244/3.15; 244/3.24

(58) Field of Search ..... 244/3.1, 3.15–3.23, 244/24, 3.25–3.3; 701/1–8

(56) References Cited

U.S. PATENT DOCUMENTS 5,590,850 A * 1/1997 Cannon et al. ..... 244/3.15

FOREIGN PATENT DOCUMENTS

EP 0747655 A2 * 12/1996 ..... F41G/7/00
GB 2190636 A * 11/1987 ..... B64C/15/14

* cited by examiner

*Primary Examiner*—Bernarr E. Gregory
(74) *Attorney, Agent, or Firm*—John F. Moran; Michael E. Sachs

(57) ABSTRACT

A guidance device for projectiles has stationary canards (40) and thrusters (50) positioned on the nose (20) of the projectile (10). The thrusters (50) are initiated from remote or local sensor to provide flight maneuverability to a target.

24 Claims, 1 Drawing Sheet

FIXED CANARDS MANEUVERABILITY ENHANCEMENT

GOVERNMENT INTEREST

The inventions described herein may be manufactured, used and licensed by or for the U.S. Government for U.S. Government purposes.

BACKGROUND OF THE INVENTION

1. Field of the Invention

This invention relates to a statically stable ballistic projectile. In particular, the statically stable projectile possesses fixed canards and thrusters that are located within the nose section of the projectile to control pitch and yaw. The projectile canards and thrusters react to a sensor guidance input or pre-programmed instructions.

2. Brief Description of the Related Art

Projectiles in weapon systems require aerodynamic stability and guidance control. Initially, basic guidance control included "point-and-fire" weapons that possess no corrective flight after launch. As projectiles became capable of longer ranges, in-flight guidance became necessary. However, this produced several weight and stability problems.

One known maneuvering mechanism uses canards. Canards provide continuous correction capability and a reduction in static margin, but the necessary actuators for the canards pose packaging and power problems on projectiles. Other maneuvering mechanisms uses discrete thrusters, providing packaging advantages over the use of canards.

In view of the foregoing, there is a need for improvements in projectile guidance.

SUMMARY OF THE INVENTION

The present invention includes a guidance device for projectiles comprising at least two canards, the canards positioned on the nose of the projectile, at least one thruster positioned on the nose of the projectile cooperatively located to influence at least one of the canards and means for guidance that controls at least part of the interaction between the at least two canards and at least one thruster for directing the projectile in flight.

The present invention also includes a system for stabilizing a projectile comprising a projectile having a guidance device having at least two canards, the canards positioned on the nose of the projectile, at least one thruster positioned on the nose of the projectile cooperatively located to influence at least one of the canards and means for guidance that controls at least part of the interaction between the at least two canards and at least one thruster for directing the projectile in flight, wherein the center of gravity is forward of the center of pressure, and the center of gravity and the center of pressure are separated by a distance of from about 20% or less of the length of the projectile.

Additionally, the present invention includes a method for creating stabilized flight of a projectile, comprising the steps of providing a projectile having a guidance device with at least two canards, the canards positioned on the nose of the projectile, at least one thruster positioned on the nose of the projectile cooperatively located to influence at least one of the canards and means for guidance that controls at least part of the interaction between the at least two canards and at least one thruster for directing the projectile in flight, launching the projectile and controlling the flight of the projectile with the guidance device.

Static margin effects the stability of the projectile, and reductions in the static margin increase maneuverability. This reduced level of static margin is designed into the configuration of the projectile by either controlling the center of gravity position or varying the mass, i.e., size or number, of the fins on the projectile.

Other and further advantages of the present invention are set forth in the description and appended claims.

DETAILED DESCRIPTION OF THE PREFERRED EMBODIMENTS

The present invention is a statically stable guided projectile. The projectile incorporates fixed canards and thrusters for guidance within the nose section, which provides damping and dynamic stability to the guided projectile. Active sensors of the guidance system also may be located on the nose section. The additional normal force from the canards on the nose section of the projectile re-positions the center of pressure closer to the center of gravity for decreased stability, while increasing maneuverability and lift. Fixed canards are used in conjunction with thrusters, causing the static margin of the existing design to be reduced, while its normal force is increased. Both of these effects increase the maneuver authority of the thrusters, without the packaging or power constraints of canard actuators.

The present invention is particularly suited for use in medium sized statically stable projectiles, such as the 120 mm, M830A1 High Explosive Anti-Tank Multi-Purpose Projectile with Tracer Cartridge. Other potential uses include the 105 mm and 120 mm Tank Extended Range Munition, and the 105 mn High Explosive Anti-Tank Multi-Purpose Projectile for the Brigade Combat Team.

Figure 1:
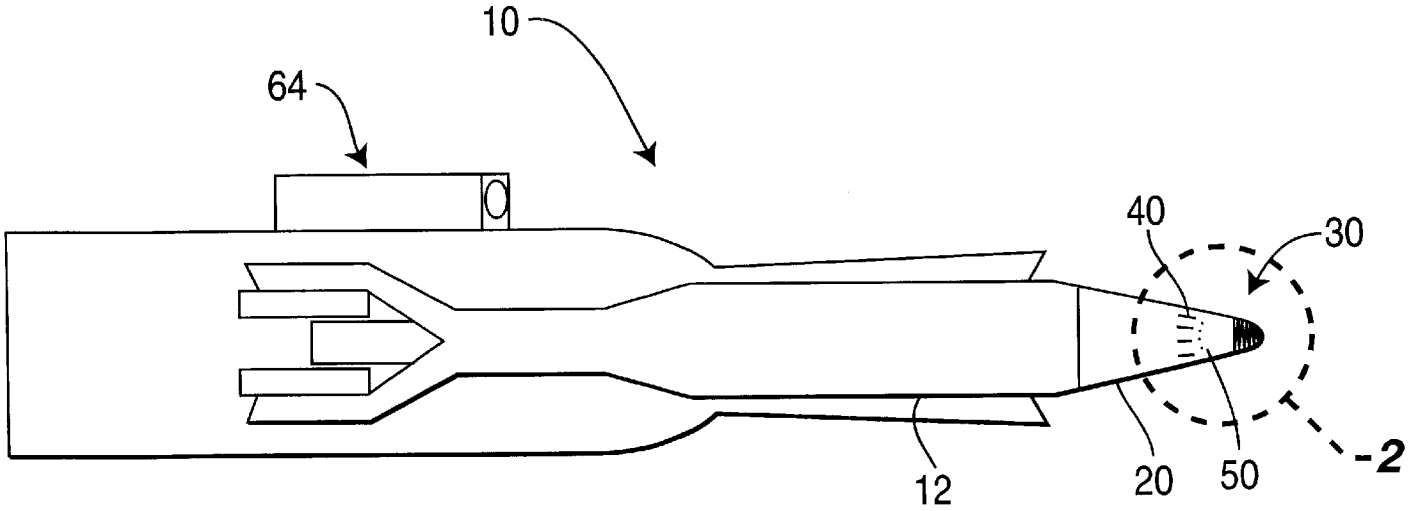
FIG. 1 is a cross-sectional view of a projectile of the present invention; and, FIG. 2 is an enlarged view of showing the nose section of the projectile in FIG. 1.

As seen in FIG. 1, a projectile or projectile system 10 of the present invention includes a body 12 and nose section 20. A guidance device or system 30 is incorporated within the nose section 20 of the projectile 10 having at least two canards 40 and at least one thruster 50 that cooperatively function to guide the projectile 10 during flight.

The projectile 10 includes any suitable ballistic munition requiring stabilized, guided flight, such as practice or "dummy" rounds, decoys, high-explosive, and other known light artillery, anti-tank and tank munitions. Generally the projectile 10 has limited length. As such, an important design consideration includes the relative location of the projectile's center of pressure relative to the projectile's center of gravity for adequate projectile control. The center of pressure should be located near and preferably slightly aft of the center of gravity.

Figure 2:
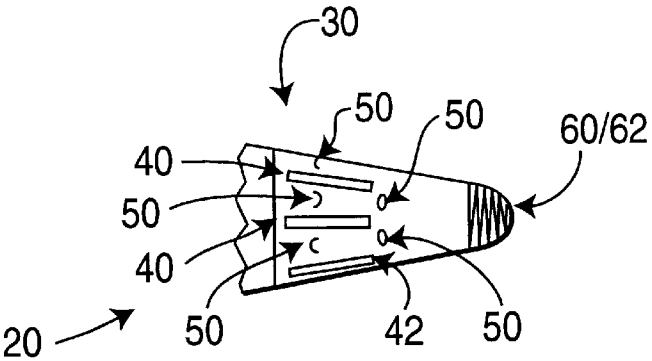

As seen in FIG. 2, the nose section 20 is attached to the forward end of the projectile 10 and comprises the guidance device 30. The nose section 20 constitutes the front of the projectile 10, such as the forward one-fifth, one-sixth, etc., as known to those skilled in the art. The guidance device 30 comprises the interacting canards 40 and thrusters 50 on the nose section 20. Additional guidance/stabilizing surfaces may be included on the projectile 10, including, for example, winged surfaces, contoured surfaces, rudders and similar drag surfaces, and other like projectile configurations that are known in the art.

The canards 40 are positioned on the exterior of the nose section 20 and align along the length of the projectile. The effect of different configurations of the canards 40, such as size, surface area, weight, shape, height, weight and length, on a given projectile are determinable by those skilled in the art, and may be varied to increase stability and maneuverability, as desired. The location of the canards 40 on the forward end or nose section 20 increases the influence of the canards 40 on the movement, i.e., change of direction, of the projectile 10, while the additional normal force of the canards 40 at the forward end of the projectile 10 causes the center of pressure to move closer to the center of gravity. The nose section 20 has at least two opposing canards 40 for proper stability, preferably comprising from about 2 or more, more preferably from about 2 to about 10 canards, and most preferably from about 4 to about 6 canards. With an odd number of canards 40, the canards 40 are spaced around the nose section 20 in a manner to balance the projectile 10, such as being off-set by 120° for three canards 40, 60° for five canards 40, etc. Although the canards 40 are preferably stationary, non-fixed moveable canards 40 may be included when the weight and size of the projectile 10 permit.

The canards 40 are positioned within the nose section 20, i.e., preferably between from about one-tenth to about one-third or one-fifth of the forward part of the projectile 10. More preferably the canards 40 are located within from about one-ninth to about one-seventh of the forward part of the projectile. The canards 40 comprise any suitable dimensions for guiding the projectile 10 such as thicknesses of from about 10% to about 1of the length of the root cord of the canards 40, i.e., the length of the canard 40 touching the nose section 20. The canards 40 preferably comprise a chamfer forward edge 42 for increased air-flow characteristics.

The thrusters 50 are positioned on the nose section 20 in a manner that allows the thrusters 50 to interact with the canards 40. Preferably, at least one thruster 50 is positioned forward of the canards 40, with more preferred arrangements included all of the thrusters 50 being forward of the canards 40. In one alternative embodiment, the one or more thrusters 50 are positioned between the canards 40. The thrusters 50 are located on the nose section 20 in a manner to most effectively influence the directional control of the canards 40. Airflow between the canards 40 increases the affect of the firing thrusters 50. Preferably the thrusters 50 are orientated perpendicular to the length of the projectile 10 and provide a single impulse, or short duration, push which permits greater guidance control of the projectile 10.

The present invention further includes a means for guidance 60, incorporating the guidance device 30, that controls at least the part of the interaction between the canards 40 and the thrusters for directing the projectile 10 in flight. This includes the interaction between the at least two canards 40 and at least one thruster 50 for flight path corrections and deviation. The means for guidance 60 comprises either a local sensors 62 or remote sensor 64. Local sensors 62 comprises sensors located completely or partially within the nose section 20. Remote sensors 64 receive a guidance input that originates away from the projectile 10, such as a laser source held by a soldier, or pre-programming instructions received prior to launch.

The guidance device 30 becomes incorporated into a stabilizing system for the projectile 10 that factors significant characteristics of the projectile 10 in flight, such as speed, weight, length, etc., for increasing maneuverability. This includes re-positioning the center of gravity of the projectile 10 forward of the center of pressure, with the distance of the center of gravity from the center of pressure within a suitable amount relative to the length of the projectile 10, preferably from about 20% or less, and more preferably from about 10% or less.

The effect of the thrusters 50 significantly increases in maneuverability by influencing the fixed canards 40 on the nose section 20. The thrusters 50 amplify the flow between and onto the fixed canards 40 allowing greater affect to maneuverability. The location of the canards 40 on the nose section 20 also increases affect for a given amount of thruster 50 influence on the canards 40. This dramatic affect allows corrective flight maneuvering without the additional weight of moveable canards located at other positions on a projectile. The size of thruster 50 is reduced from both the stability of the projectile 10 and the increased affect on the canards 40 while providing a comparable affect.

In operation, the projectile 10 maintains stabilized ballistic flight after launch. Once pre-programming or sensor input initiates controlled guidance of the projectile 10, the thrusters 50 are selectively fired to control flight direction. The projectile 10 is controlled with the guidance device 30, achieving statically stable flight having static margins of from about 20% or less, with decreasing static margins preferred, such as from about 15% or less, 10% or less and 5% or less. Ranges of static margins are attainable for given physical configurations, such as from about 20% to about 15% and 10% to about 5% of total length of the projectile 10. This provides good damping of initial pitch, yaw rates, and dynamic stability, while allowing maneuverability. Normal forces are increased by the additional lifting surfaces provided by the canards.

The present invention may be incorporated into existing cartridges, i.e., retrofits of existing designs, or may be used on new or "clean sheet" designs. Modification of existing cartridges may be accomplished by changing or "swapping out" the nose section of the projectile that contains the fuzing and sensor elements with a nose section that contains sensors and maneuvering mechanisms which decreases the cost of cartridge disassembly.

The following examples are provided to illustrate the use of the present invention on existing weapon systems. The examples are prophetic.

EXAMPLE 1

An artillery projectile, a 155 artillery round, is constructed with a replacement nose having four discrete thrusters interspersed between four fixed canards. The artillery projectile has a length of 0.6 meters. The canards are located 10 centimeters from the forward end of the nose and extend 15 centimeters. A sensor is located at the forward end of the nose. The sensor is connected to an on board computer that calculates and initiates thrust from the individual thrusters for in-flight corrections.

EXAMPLE 2

A shoulder launched anti-tank projectile, the Ranger Anti-Armor Weapon System (RAWS), is constructed with a nose having six discrete thrusters interspersed between six fixed canards. The anti-tank projectile has a length of 0.75 meters. The canards are located 10 centimeters from the forward end of the nose and extend 8 centimeters. A sensor is located at the forward end of the nose. The sensor is connected to an on board computer that calculates and initiates thrust from the individual thrusters for in-flight corrections.

EXAMPLE 3

A tank projectile, the 120 mm, M830A1 High Explosive Anti-Tank Multi-Purpose Projectile with Tracer Cartridge, is constructed with a replacement nose having eight discrete thrusters interspersed between four stationary canards. The tank projectile has a length of 0.78 meters. The canards are located 8 centimeters from the forward end of the nose and extend 5 centimeters. A remote sensor, a hand-held laser, is used to irradiate a target, with the reflected radiation received by a passive receiver on board the projectile to guide the projectile to the target.

It should be understood that the foregoing summary, detailed description, examples and drawings of the invention are not intended to be limiting, but are only exemplary of the inventive features which are defined in the claims.

What is claimed is:

1. A guidance device for a projectile, comprising:

at least two canards, the canards positioned on a nose of the projectile;

at least one thruster positioned on the nose of the projectile so that when the thruster is activated during flight, air flow from the thruster travels between, and cooperates with the canards, to enhance the effect of the thruster; and means for guidance that controls an interaction between the thruster and the canards for directing the projectile in flight.

2. The guidance device of claim 1, comprising at least four stationary canards.

3. The guidance device of claim 1, wherein the canards are positioned within approximately one-tenth to approximately one-third of a forward part of the projectile.

4. The guidance device of claim 3, wherein the canards are positioned within approximately one-tenth to approximately one-fifth of the forward part of the projectile.

5. The guidance device of claim 4, wherein the canards are positioned within approximately one-ninth to approximately one-seventh of the forward part of the projectile.

6. The guidance device of claim 1, comprising from approximately 2 to approximately 10 canards.

7. The guidance device of claim 6, comprising from approximately 4 to approximately 6 canards.

8. The guidance device of claim 1, wherein the canards comprise a thickness of from approximately 10% to approximately 15% of a length of a root cord of the canards.

9. The guidance device of claim 1, wherein the canards comprise a chamfer forward edge.

10. The guidance device of claim 1, wherein the at least one thruster is positioned forward of the canards.

11. The guidance device of claim 1, wherein the at least one thruster is positioned between the canards.

12. The guidance device of claim 1, wherein the means for guidance comprises a local sensor.

13. The guidance device of claim 1, wherein the means for guidance comprises a remote sensor.

14. The guidance device of claim 1, wherein the means for guidance comprises a preprogramed command sequence.

15. An artillery projectile comprising the guidance device of claim 1.

16. An anti-tank projectile comprising the guidance device of claim 1.

17. A tank projectile comprising the guidance device of claim 1.

18. The guidance device of claim 1, wherein a normal force from the canards on the nose re-positions a center of pressure closer to a center of gravity of the projectile; and wherein the center of gravity and the center of pressure are separated by a distance of from approximately 20% or less of the length of the projectile.

19. The guidance device of claim 18, wherein the center of gravity is forward of the center of pressure and the center of pressure are separated by a distance of from approximately 10% or less of the length of the projectile.

20. The guidance device of claim 1, wherein at least two canards are oppositely disposed on the nose.

21. The guidance device of claim 1, wherein the canards include stationary canards.

22. The guidance device of claim 1, wherein the canards include moveable canards.

23. The guidance device of claim 1, wherein at least one canard is aligned substantially along a length of the projectile.

24. The guidance device of claim 23 wherein the thruster is oriented substantially perpendicular to the length of the projectile.

* * * * *